US006691442B2

(12) United States Patent
Gross

(10) Patent No.: US 6,691,442 B2
(45) Date of Patent: Feb. 17, 2004

(54) INTEGRATED SLIDE VIEWER AND CLIPHOLDER APPARATUS

(75) Inventor: Janice Gross, Princeton, NJ (US)

(73) Assignee: MDDM, Inc., Kingston, NJ (US)

( * ) Notice: Subject to any disclaimer, the term of this patent is extended or adjusted under 35 U.S.C. 154(b) by 0 days.

(21) Appl. No.: 10/033,760

(22) Filed: Dec. 27, 2001

(65) Prior Publication Data

US 2002/0139022 A1 Oct. 3, 2002

Related U.S. Application Data

(60) Provisional application No. 60/279,378, filed on Mar. 28, 2001.

(51) Int. Cl.[7] ..... G09F 11/04

(52) U.S. Cl. ..... 40/495; 281/45; 248/444.1; 248/451; 116/307; 40/658

(58) Field of Search ..... 40/495, 489–492, 40/658; 281/45; 248/444.1, 451, 452; 116/309, 318, 321, 307, 308

(56) References Cited

U.S. PATENT DOCUMENTS

| | | | | | |
|---|---|---|---|---|---|
| 328,221 | A | | 10/1885 | Hood | |
| 2,544,688 | A | | 3/1951 | Kelley | |
| 3,232,685 | A | | 2/1966 | Wilstein et al. | |
| D218,720 | S | | 9/1970 | Shahan | |
| 3,589,327 | A | | 6/1971 | Jacobs | |
| 3,646,681 | A | | 3/1972 | Koenig | |
| 3,739,478 | A | * | 6/1973 | Eisenberger | 33/431 |
| 4,041,893 | A | * | 8/1977 | Mulloy | 116/308 |
| 4,044,710 | A | * | 8/1977 | Hansen | 116/312 |
| 4,157,626 | A | | 6/1979 | Bedinghaus | |
| 4,610,054 | A | | 9/1986 | Malian | |
| 4,665,620 | A | * | 5/1987 | Osteen | 33/760 |
| 4,858,354 | A | * | 8/1989 | Gettler | 40/324 |
| 5,016,147 | A | * | 5/1991 | Voorhees | 362/99 |
| 5,046,760 | A | | 9/1991 | Krepp | |
| 5,145,141 | A | | 9/1992 | Hunter | |
| 5,214,855 | A | | 6/1993 | Gibbs | |
| 5,324,076 | A | * | 6/1994 | Nieradka | 281/45 |
| 5,823,500 | A | * | 10/1998 | La Coste | 248/444 |
| 5,887,839 | A | * | 3/1999 | Smith et al. | 248/452 |
| 5,887,902 | A | | 3/1999 | Irwin et al. | |
| 6,024,384 | A | * | 2/2000 | Jones et al. | 281/45 |
| 6,217,075 | B1 | * | 4/2001 | Tsai | 281/45 |

FOREIGN PATENT DOCUMENTS

| | | |
|---|---|---|
| CH | 194726 | 3/1938 |
| DE | 545534 | 3/1932 |
| DE | 1078360 | 4/1957 |
| GB | 2297723 | 8/1996 |

OTHER PUBLICATIONS

Karl W. Maier, "Time Diplacement" pp. 208–209 date unknown.

* cited by examiner

*Primary Examiner*—William L. Miller
(74) *Attorney, Agent, or Firm*—Synnestvedt, Lechner & Woodbridge, LLP; Richard C. Woodbridge, Esq.; Roy Rosser

(57) ABSTRACT

A clipboard apparatus includes a compact integrated slide viewer. The clipboard section comprises a top layer, a middle layer and a bottom layer plus a document holding, spring loaded clip attached to the upper edge of the multi-layered board. According to the preferred embodiment of the invention, the middle layer includes a cavity for receiving a rotatable wheel. Indicia on the rim of the wheel are viewable through a transparent window in the top layer of the multilayered clipboard. The wheel extends through an aperture in the side of the board so that the wheel can be rotated and information read off of the indicia through the transparent viewing window. According to an alternative embodiment of the invention, the cavity is square and receives a rectangular slide that moves into and out of the cavity through a side aperture. Transparent windows on the top and bottom layers make it possible to view indicia on the slide from both sides of the multilayered clipboard.

8 Claims, 7 Drawing Sheets

INTEGRATED SLIDE VIEWER AND CLIPHOLDER APPARATUS

CROSS REFERENCE TO RELATED APPLICATIONS

This application is related to and claims the priority of my co-pending provisional U.S. application entitled COMBINATION CLIPBOARD/SLIDE VIEWER now Ser. No. 60/279,378, filed Mar. 28, 2001, the priority of which is hereby claimed, and the entire contents and substance of which is hereby incorporated in total by reference.

BACKGROUND OF THE INVENTION

1. Field of the Invention

The invention relates to an integrated, compact slide viewer having a document holding, spring-loaded clip at the top thereof.

2. Description of Related Art

There appears to be a need for a compact, convenient paper holding device, which can also incorporate, effectively, a mechanical slide or rotatable viewer. Individuals who are good candidates for such a device would include doctors, construction workers, and other individuals who need to have ready access to information and where the information is safely stored.

There are a few prior art efforts to combine paper holding devices and calculators. Typical of the prior art is U.S. Pat. No. 3,589,327, entitled "Portable Pilot Aid Device". That invention comprises a hinged, two-part member defining there between a space which receives a map or chart. On the upper surface of the member is disposed a paper sheet or pad retaining spring clip and calculator which may be on a navigational style circular slide rule. The slide rule, however, is mounted on top of the clipboard members and is not readily accessible for use. Accordingly, it could be damaged and is more bulky than is desirable.

U.K. Patent Application 2,297,723 A describes a "Retractable Sheet Notepad" comprising box attachable to a clipboard and which carries a plurality of individual sheets which are selectively slid apart or substantially pulled out of the box, while being retained thereby, so that such sheets may be viewed.

U.S. Pat. No. 5,214,855 describes an "Instrument Flight Navigational Apparatus and Method" which includes a flat board and a mounting clip on the backside of the flat board. The clip retains airport approach plates in place. The front side of the board mounts a template, a protractor, and a pointer arrow. In addition, the front side of the board also includes indicia.

U.S. Pat. No. 3,646,681 is of possible relevance in that it describes a navigational computer incorporated into a clipboard.

The following U.S. Patents appear to describe prior art techniques that may be of lesser relevance, but nevertheless of general interest, with regard to the state of the art: U.S. Pat. Nos. 328,221; 3,232,685, 4,157,626; 4,610,054; 5,046,760; 2,544,688; 5,145,141; and, 5,887,902.

The following foreign prior art patents also describe structures of possible relevance: German Patent 545,534; West German Patent 1,078,360; and Swiss Patent 194,726.

Lastly, it is noted that pages 208–209 of an article or book by Karl W. Maier, entitled "Time Displacement" describes a clipboard-like structure including a slide rule device.

While the prior art discloses bits and pieces of combinations of clip-board like devices and calculators, nevertheless, there do not appear to be any which incorporate, in a compact fashion, a rotatable or slidable rule which can be viewed either through the top or bottom surface of a clipboard and can be manipulated easily from the side thereof. It is within the context of the foregoing that the following invention arose.

SUMMARY OF THE INVENTION

Briefly described, the invention comprises a slidable or rotatable viewer integrated in a compact and efficient fashion into a multilayer clipboard.

According to the preferred embodiment of the invention, the clipboard is multilayered and includes a top layer, a middle layer and a bottom layer. The middle layer includes a circular cavity, which accommodates a wheel having indicia on the rim thereof. The cavity includes an aperture on the right and side of the board so that the wheel can be manipulated when the top, middle and bottom layers are sandwiched together with adhesive. The indicia on the rim of the wheel are viewable through a ring-shaped circular window on the top surface of the multilayer clipboard. Indicia are also located on the front layer to match with the indicia on the wheel.

According to a second embodiment of the invention, the cavity in the middle layer is square or rectangular in shape so as to accommodate a square or rectangular slide, which moves in a linear fashion into and out of the aperture. The slide may include a pair of ears to engage with their counterparts at the edge of the aperture so as to prevent the slide from being fully withdrawn from the cavity. The top and bottom layers both include windows through which indicia on the slide member can be viewed.

These and other features of the invention may be more fully understood by reference to the following drawings.

DETAILED DESCRIPTION OF THE PREFERRED EMBODIMENT

During the course of this description like numbers will be used to indicate like elements according to the different figures that illustrate the invention.

Figure 1:
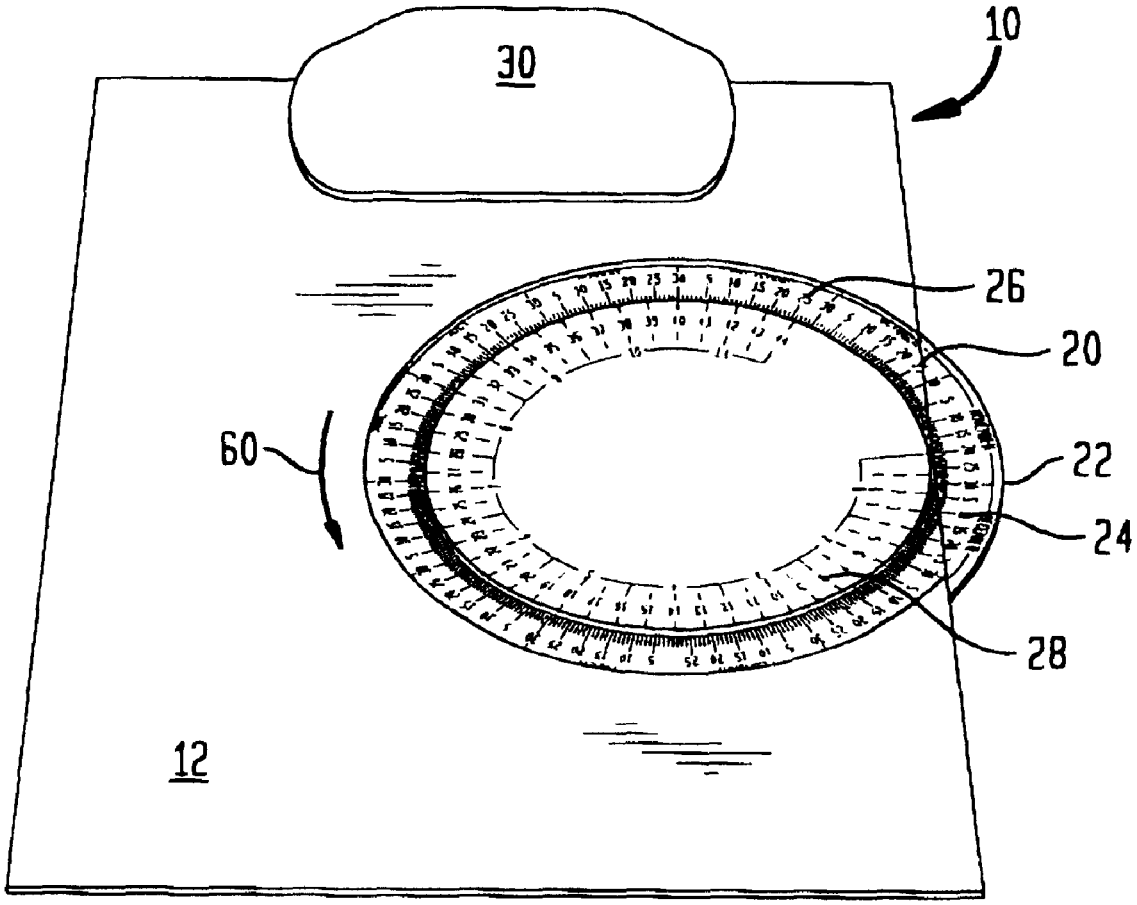
FIG. 1 is a top plan view of the preferred embodiment of the invention incorporating a circular data wheel.
Figure 2:
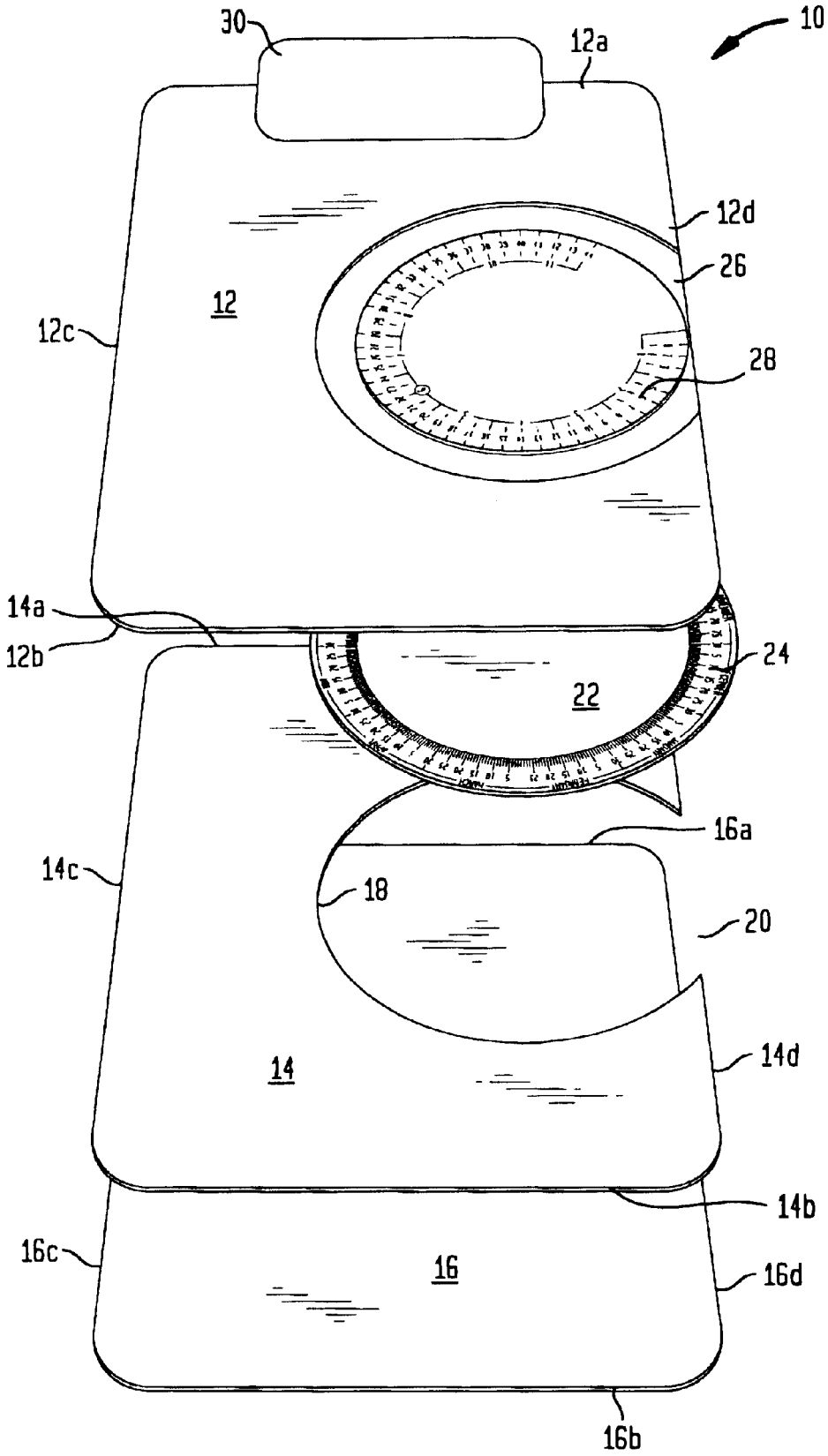
FIG. 2 is an exploded view of the preferred embodiment of the invention illustrated in FIG. 1.

The preferred embodiment of the invention 10 is illustrated in FIGS. 1 and 2. Referring specifically to FIG. 2, the primary elements of the invention include a top layer 12, middle layer 14 and a bottom layer 16. A spring-loaded clip 30 is mounted on the top of the multilayer sandwich and is adapted to hold papers or other loose flat articles. Top layer 12 includes a top edge 12*a*, a bottom edge 12*b*, a left side edge 12*c* and a right side edge 12*d*. Likewise, the middle layer 14 includes a top edge 14*a*, a bottom edge 14*b*, a left edge 14*c* and a right edge 14*d*. In addition, the middle layer includes a circular cavity 18, which creates an aperture 20 on the right side edge 14*d* of the middle layer 14. Lastly, the bottom layer 16 includes a top edge 16*a*, a bottom edge 16*b*, a left edge 16*c* and a right edge 16*d*.

The top layer 12 includes a ring-like transparent window section 26. A circular set of indicia 28 is located concentrically in the middle of the transparent ring-like window section 26. A circular wheel 22 having indicia 24 on the rim thereof fits snugly, but rotatably, in the circular cavity 18 such that a portion of the circular wheel 22 extends beyond the aperture 20 so that the edge of the wheel can be manipulated and turned in the direction of arrow 60. In this fashion, the circular wheel 22 can be used as a calculator when the indicia 24 on the rim line up with the indicia 28 on the transparent window 26. The invention 20 has the advantage that it is fully integrated in the clipboard structure so that it takes up no additional room and is fully protected by the top and bottom layers 12 and 16. It is also especially convenient for the user because it is always connected to the clipboard, which may contain relevant information with regard to the calculations to be made on the circular wheel 22.

Figure 3A:
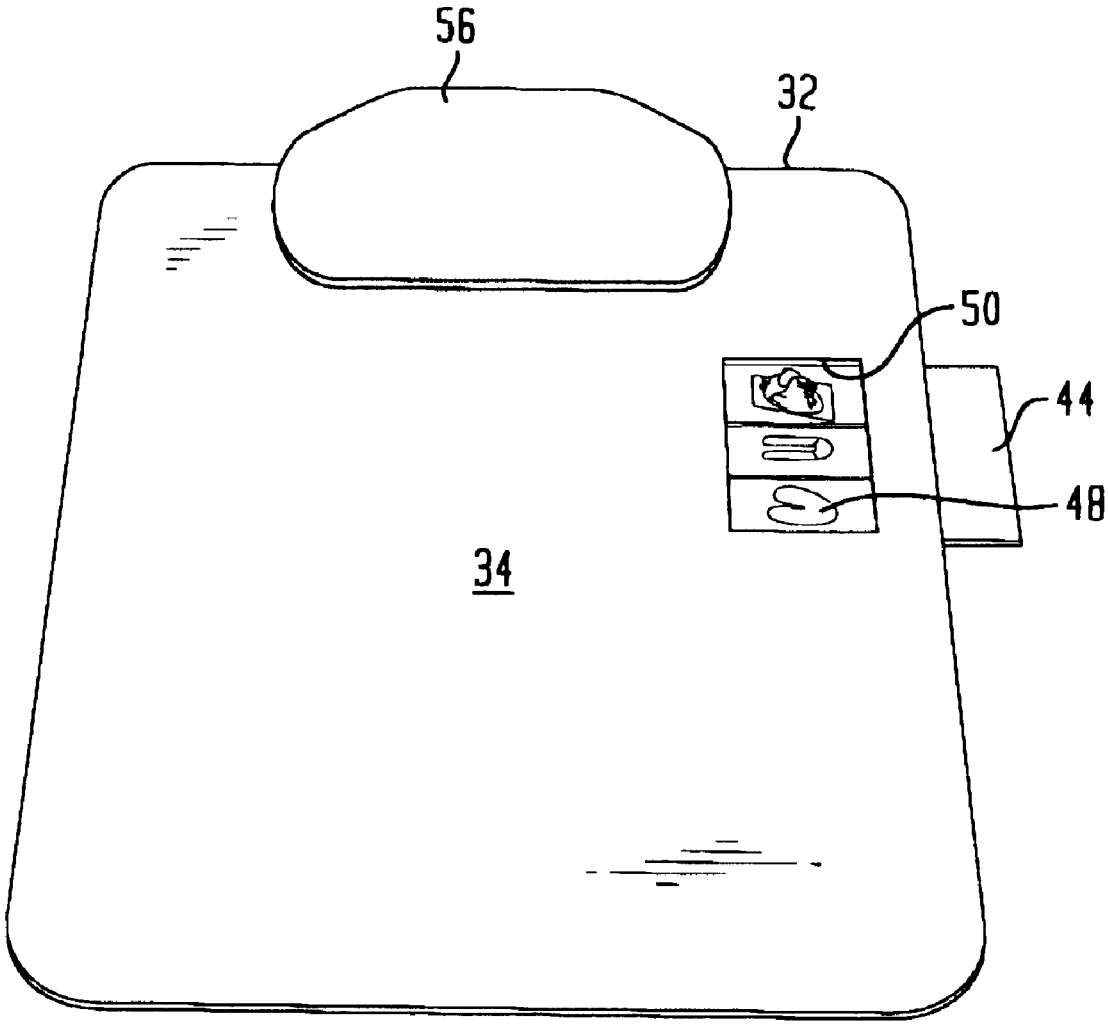
FIG. 3A is a top plan view of an alternative embodiment of the invention, which incorporates a linear, a rectangular slide data viewer in its fully retracted position.
Figure 3B:
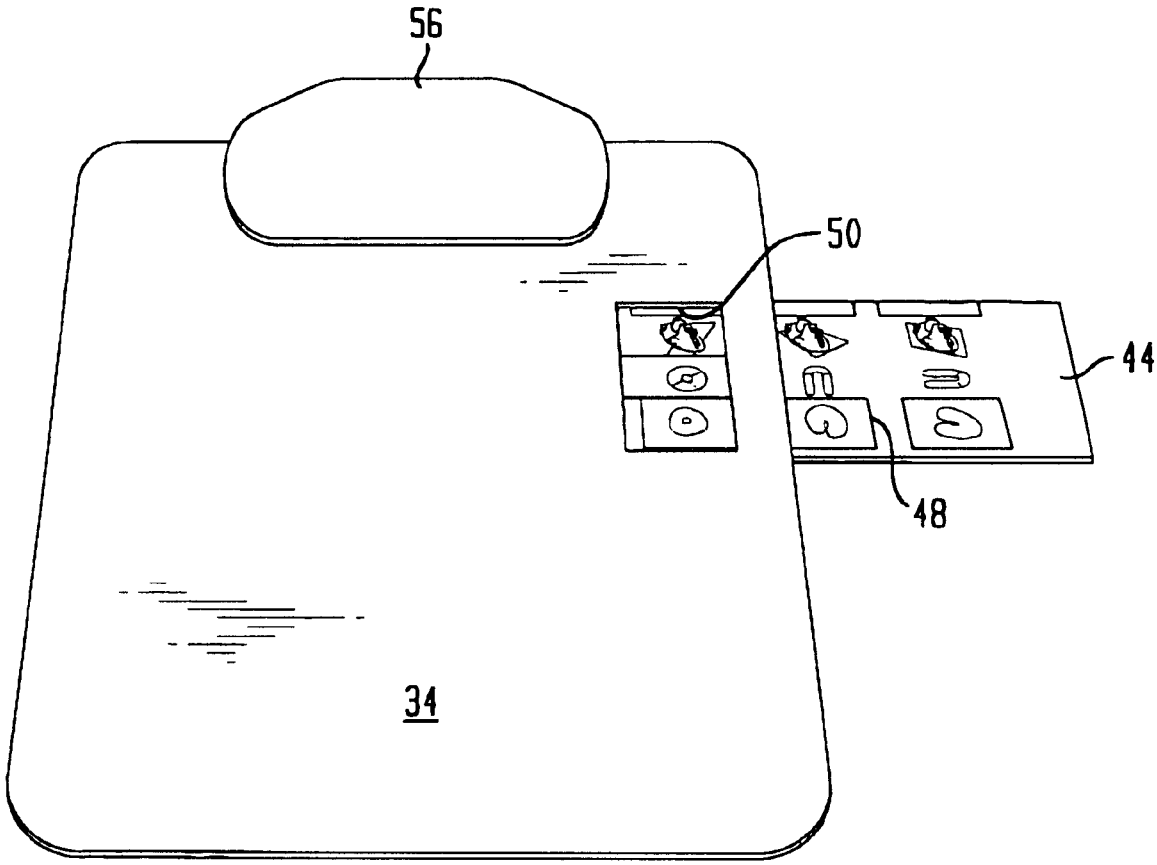
FIG. 3B illustrates the alternative embodiment of the invention shown in FIG. 3A with the slide viewer fully withdrawn from the cavity.
Figure 3C:
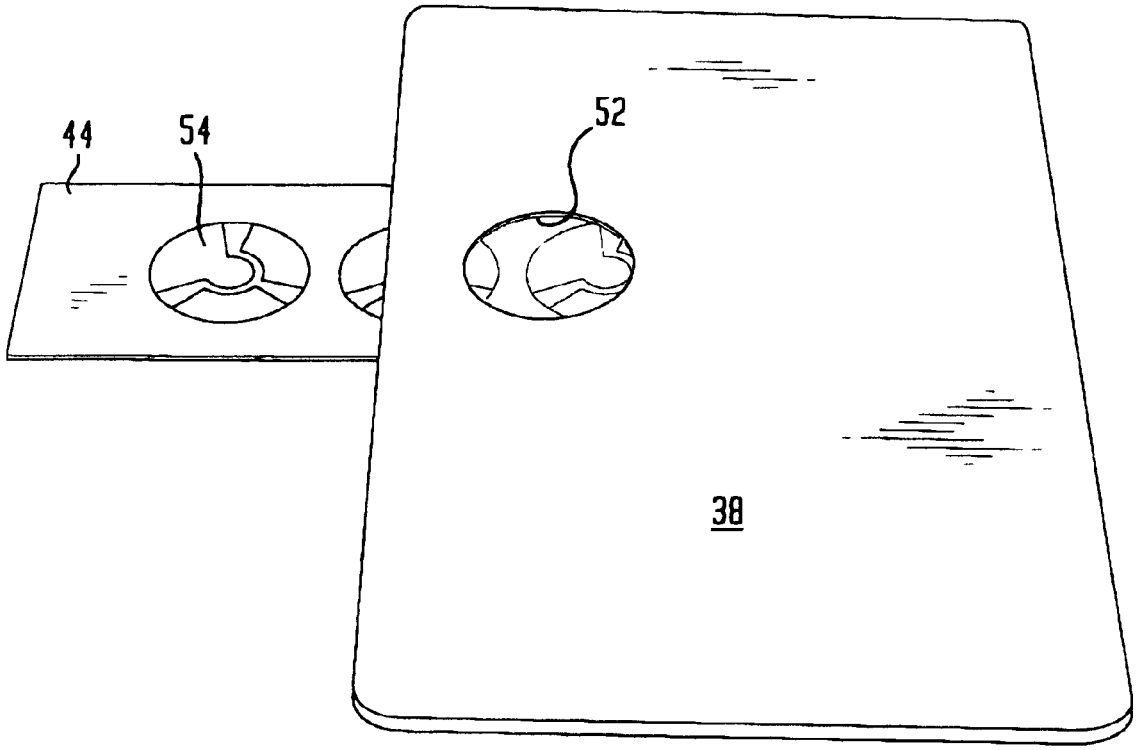
FIG. 3C is a bottom plan view of the alternative embodiment of the invention shown in FIGS. 3A and 3B with the slide fully withdrawn.
Figure 4A:
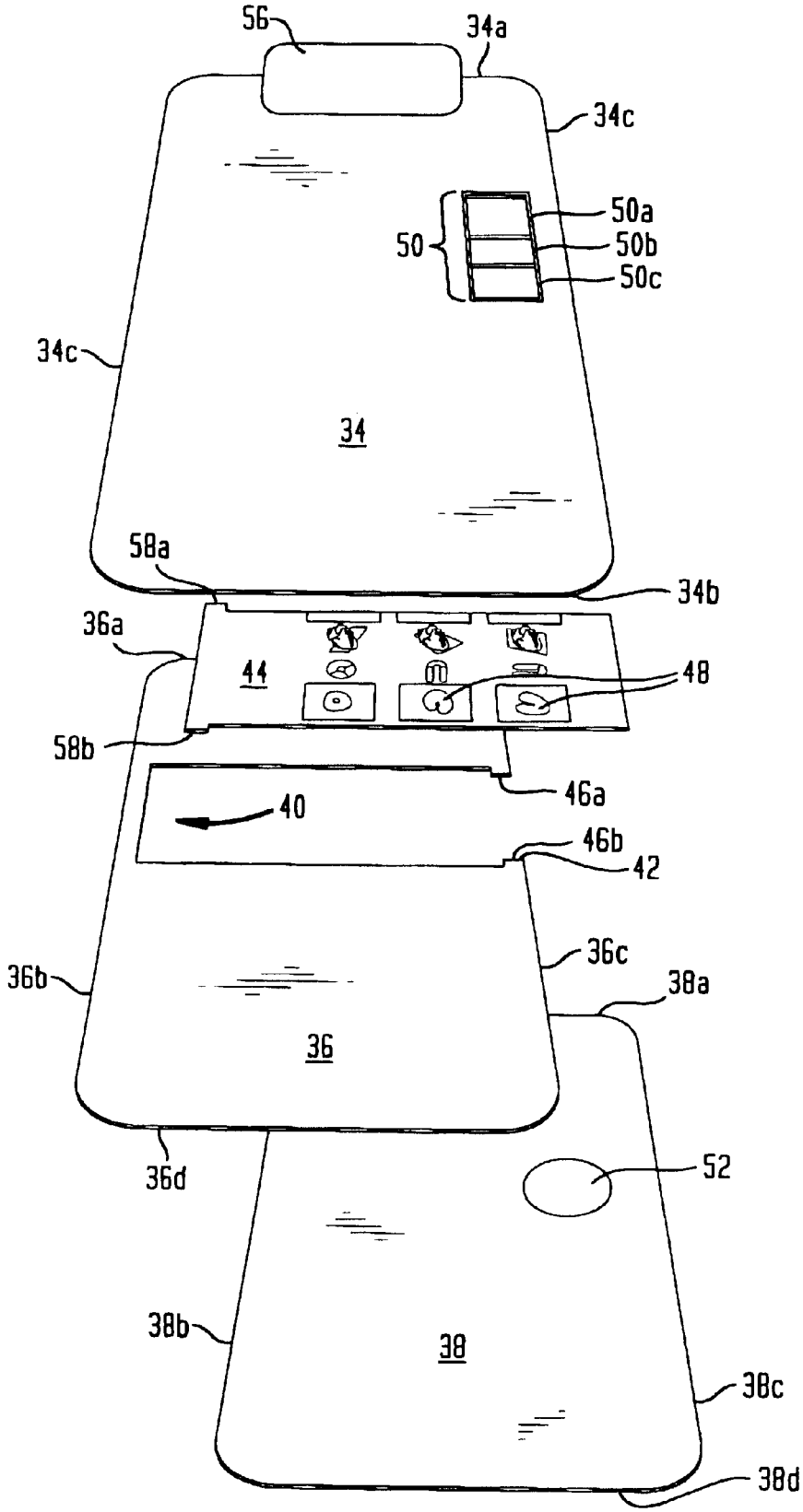
FIG. 4A is an exploded view of the alternative embodiment of the invention illustrated in FIGS. 3A–3C as seen from the front.
Figure 4B:
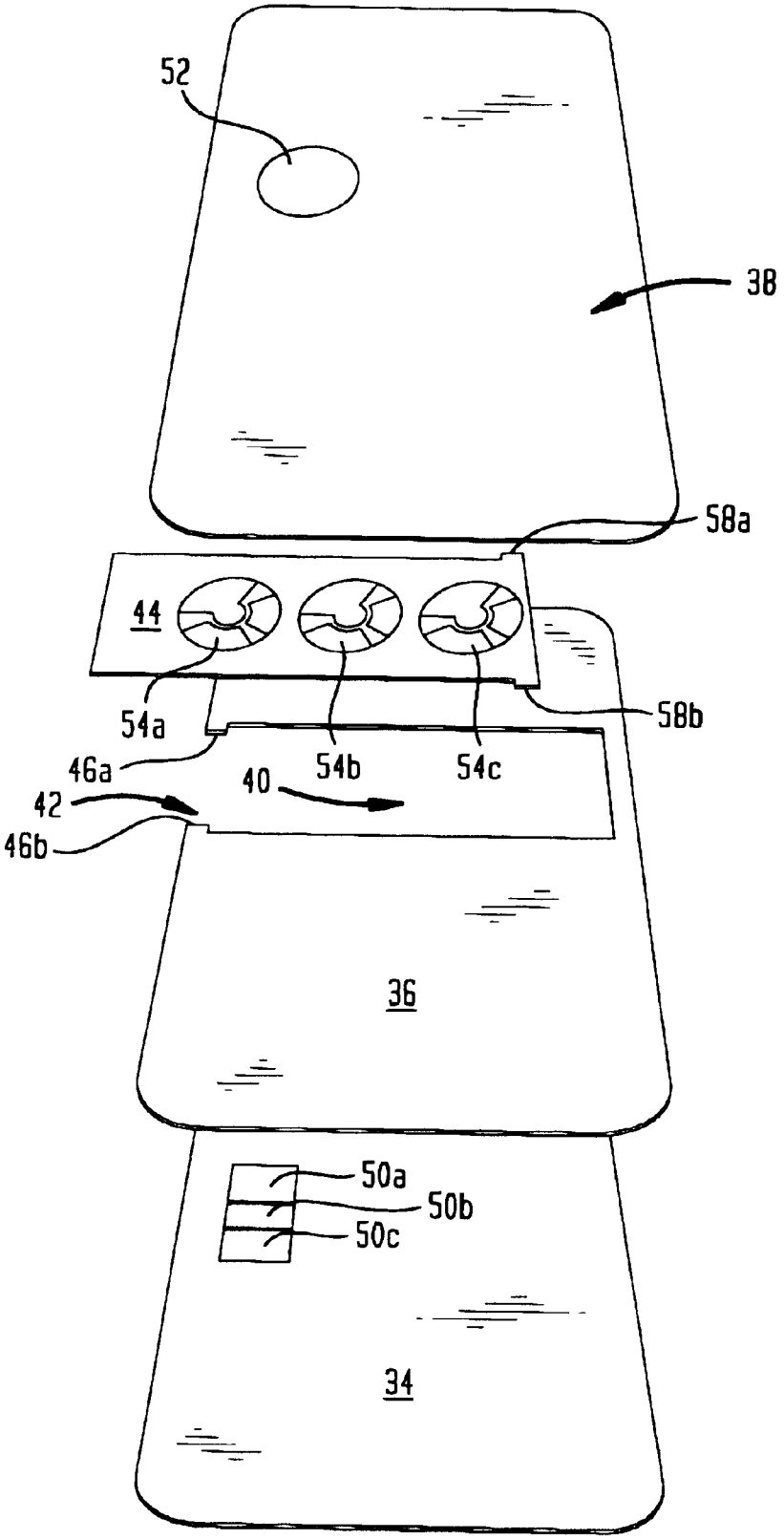
FIG. 4B is an exploded view of the alternative embodiment of the invention illustrated in FIGS. 3A–3C as seen from behind.

A linear alternative slide embodiment 32 is illustrated in FIGS. 3A=4B. Like the circular slide rule preferred embodiment 10, the linear slide rule alternative embodiment 32 includes a top layer 34, a middle layer 36 and a bottom layer 38. Top layer 34 includes a top edge 34*a*, a bottom edge 34*b*, a left side 34*c*, and a right side 34*d*. Middle layer 36 includes a top edge 36*a*, a bottom edge 36*b*, a left edge 36*c* and a right edge 36*d*. Finally, bottom layer 38 includes a top edge 38*a*, a bottom edge 38*b*, a left side 38*c* and a right side 38*d*. Middle layer 36 includes a square or rectangular cavity 40, which is accessible through an aperture 42 in the right edge 36. Aperture 42 is further defined by a pair of stop ears 46*a*, 46.

Top layer 34 includes three transparent windows, specifically top window 50*a*, a middle window 50*b* and a bottom window 50*c*. Similarly, the bottom layer 38 includes a transparent circular window 52. A spring loaded clip 46 is located on the top edge 342 of the top layer 34 in a manner similar to that of the clip 30 located on the edge 12*a* of preferred embodiment 10.

A rectangular slide 44 having indicia 48 on the topside thereof and additional indicia 54 on the bottom side thereof fits snugly and slidably in cavity 40. Slide 44 includes a pair of stop ears 58*a* and 58*b* which contact the stop ears 46*a* and 46*b* at aperture 42 to prevent the slide 44 from becoming fully withdrawn from cavity 40. The indicia 48 on the top of slide 44 match up with windows 50*a*, 50*b* and 50*c*, respectively, so that information can be read there off of. Similarly, the alternative embodiment 32 can be flipped upside down and indicia 54 can be read through the transparent circular window 52 in the bottom layer 38. Therefore, the alternative embodiment 32 has the advantage that twice as much information can be read from the slide 44 because information is present on both the front 48 and back 54 thereof.

In summary, the foregoing has several advantages over the prior art. First, the structures are integrated into a clipboard arrangement so that they do not take up unnecessary room. Second, because the structures are integrated, they are protected from damage. Third, because the structures are compact, they are relatively easy to use. Fourth, because only a small portion of each movable member 22 or 44 extends past the apertures 20 and 42, respectively, the items as a whole are relatively small. Fifth, the structures are relatively economical to produce. Sixth, the structures are especially convenient for people such as medical students, construction workers and the like because the users are able to make important calculations based upon the documents held by the clips 30 and 56.

While the invention has been described with reference to the preferred embodiment thereof, it will be appreciated by those of the ordinary skill in the art that modifications can be made to the structure of the invention without departing from the spirit and scope of the invention as a whole. For example, it would be possible to add a transparent window on the backside of the preferred embodiment 10 so that indicia can be read from both the front and back of the apparatus.

I claim:

1. An integrated slide viewer apparatus comprising:

a first substantially flat layer having a top surface and a bottom surface and a top, bottom and a first and second edge, said first layer having at least a first substantially transparent window section therein such that said top surface of said first flat layer and said first transparent window form a single, contiguous, supporting surface;

a clip attached adjacent to the top edge of said first layer capable of supportably holding relatively flat sheets substantially equal in size to said first layer;

a second substantially flat layer having substantially the same dimensions as said first layer and having a top, bottom and a first and second edge;

a third substantially flat layer having substantially the same dimensions as said first layer sandwiched between said first and second layers, said third layer having a first and second edge and including a cavity that extends to said first edge creating an aperture at said first edge of said third layer between two edges of said first and second layers;

a substantially flat movable member, of substantially the same thickness as said third layer and larger in area than said cavity, located partially in said cavity and also extending partially beyond said cavity through said aperture; and, indicia located on said movable member which is viewable through said first window section, wherein the portion of said movable member extending through said aperture can be manipulated so that selected information can be read from said indicia visible through said first transparent window section.

2. The apparatus of claim 1 wherein said movable member is substantially circular in shape and may be rotated within said cavity by manipulating the part that extends through said aperture.

3. The apparatus of claim 1 wherein said movable member is substantially rectangular in shape and said movable member may be caused to slide into and out of said cavity by manipulating the part of said movable member that extends beyond said aperture.

4. The apparatus of claim 3 wherein said movable member includes a stop thereon that cooperates with said aperture to prevent said movable member from being fully removed from said cavity.

5. The apparatus of claim 4 wherein said first layer includes at least a second substantially transparent window section therein so that additional information can be read from said indicia viewable through said second window section.

6. The apparatus of claim 1 wherein said movable member has a first and second side and said indicia is located on both of said sides and said apparatus further includes a second substantially transparent window section located in said second layer so that information can be read from said indicia on said movable member viewable through said second substantially transparent window section.

7. The apparatus of claim 1 wherein said indicia comprise pharmaceutical indicia.

8. The apparatus of claim 1 wherein said indicia comprise medical indicia.

* * * * *